US007642986B1

(12) United States Patent
Althouse

(10) Patent No.: US 7,642,986 B1
(45) Date of Patent: Jan. 5, 2010

(54) RANGE LIMITED ANTENNA

(75) Inventor: Mark L. G. Althouse, Bel Air, MD (US)

(73) Assignee: The United States of America as represented by the Director, National Security Agency, Washington, DC (US)

( * ) Notice: Subject to any disclaimer, the term of this patent is extended or adjusted under 35 U.S.C. 154(b) by 303 days.

(21) Appl. No.: 11/974,003

(22) Filed: Sep. 19, 2007

Related U.S. Application Data

(63) Continuation-in-part of application No. 11/268,412, filed on Nov. 2, 2005, now Pat. No. 7,292,202.

(51) Int. Cl.
*H01Q 21/00* (2006.01)

(52) U.S. Cl. ..... 343/844

(58) Field of Classification Search ..... 343/842–844, 343/742, 854; 455/561–562
See application file for complete search history.

(56) References Cited

U.S. PATENT DOCUMENTS 4,143,379 A * 3/1979 Wheeler ..... 342/368
4,353,073 A 10/1982 Brunner et al.
4,903,333 A 2/1990 Aizawa
6,011,524 A * 1/2000 Jervis ..... 343/895
6,067,055 A * 5/2000 Vaidyanathan ..... 343/844
6,218,987 B1 4/2001 Derneryd et al.
6,252,553 B1 * 6/2001 Solomon ..... 343/700 MS
6,664,921 B2 12/2003 Pratt
6,680,709 B2 1/2004 Kitagawa
6,839,572 B2 1/2005 Erhage et al.
6,985,123 B2 1/2006 Göttl
7,215,297 B2 5/2007 Gothard et al.
7,482,992 B2 * 1/2009 Skafidas et al. ..... 343/844

OTHER PUBLICATIONS

U.S. Appl. No. 11/093,340, filed Sep. 15, 2005, Ghavami.

* cited by examiner

*Primary Examiner*—Huedung Mancuso
(74) *Attorney, Agent, or Firm*—Eric Froehlich

(57) ABSTRACT

Range limited antenna includes at least two sets of antenna elements and an RF signal processing network connected to each set of antenna elements. The network has a function, $F(\Xi,x)=\Phi_A(x)-\Phi_B(x)+\Phi_C(x)-\Phi_D(x) \ldots +\Phi_{N-1}(x)-\Phi_N(x)$, where x is a signal, $\Phi_A(x)$ is the phase angle of signal x at the first element set, $\Phi_B(x)$ is the phase angle of signal x at the second element set, $\Phi_N(x)$ is the phase angle of signal x at the set N, and $\Xi$ contains all additional parameters which bear on the system. The network is configured to pass a signal for which $F(\Xi,x)>\epsilon$, where $\epsilon$ is a threshold amount, such that the antenna has gain to signals within a radius and has attenuation outside the radius.

20 Claims, 4 Drawing Sheets

RANGE LIMITED ANTENNA

CROSS REFERENCE TO RELATED APPLICATIONS

This application is a continuation-in-part of prior U.S. patent application Ser. No. 11/268,412, filed Nov. 2, 2005, now U.S. Pat. No. 7,292,202.

FIELD OF THE INVENTION

The present invention relates generally to a range-limited antenna that has gain for signal sources within some radius about the antenna and attenuation for signal sources outside of the radius or, conversely, has gain outside the radius and attenuation within the radius.

BACKGROUND OF THE INVENTION

Since the impinging signal sources in most RF environments are distributed over a very wide physical area, an RF survey concerned with signal sources within a limited physical region is difficult due to the effort of manually determining which signals are in the region of interest. Known patent documents include:

U.S. Pat. No. 4,353,073;

U.S. Pat. No. 4,903,333;

U.S. Pat. No. 6,218,987;

U.S. Pat. No. 6,664,921; and

U.S. Pat. No. 6,680,709.

SUMMARY OF THE INVENTION

The present invention provides an antenna comprising a number of sets of elements and a RF signal-processing network such that the antenna is sensitive (has gain) to signals within a user-selectable range from the antenna and insensitive (has attenuation) to signals outside the user-selected range.

An embodiment of the invention comprises two or more antenna elements and a RF signal processing network connected to paired sets of antenna elements. The network has a function, $F(\Xi,x)=\Phi_A(x)-\Phi_B(x)+\Phi_C(x)-\Phi_D(x) \ldots +\Phi_{N-1}(x)-\Phi_N(x)$, where x is a signal, $\Phi_A(x)$ is the phase angle of signal x at the first element set, $\Phi_B(x)$ is the phase angle of signal x at the second element set, $\Phi_C(x)$ is the phase angle of signal x at the third element set, $\Phi_D(x)$ is the phase angle of signal x at the fourth element set, $\Phi_{N-1}(x)$ is the phase angle of signal x at the N−1st element set, $\Phi_N(x)$ is the phase angle of signal x at the $N^{th}$ element set, and $\Xi$ contains all additional parameters which bear on the system. N is generally even since most antenna array geometries of the invention are comprised of some number of symmetric pairs of sets of antenna elements. Sets A and B are geometrically paired, as well as sets C and D and sets N−1 and N. In a two-set system, $F(\Xi,x)=\Phi_A(x)-\Phi_B(x)$. The network is configured to pass a signal for which $F(\Xi,x)>\epsilon$, where $\epsilon$ is a threshold amount, chosen by the user, such that the antenna has gain to signals within a chosen radius, r, and has attenuation outside the radius. Given all the other parameters of a range-limited antenna, $\epsilon$ can be calibrated to r.

In another embodiment of the invention, the network is configured to pass a signal for which $F(\Xi,x)<\epsilon$, where $\epsilon$ is a threshold amount, such that the antenna has gain to signals outside the radius and has attenuation inside the radius.

DETAILED DESCRIPTION OF THE INVENTION

Figure 1:
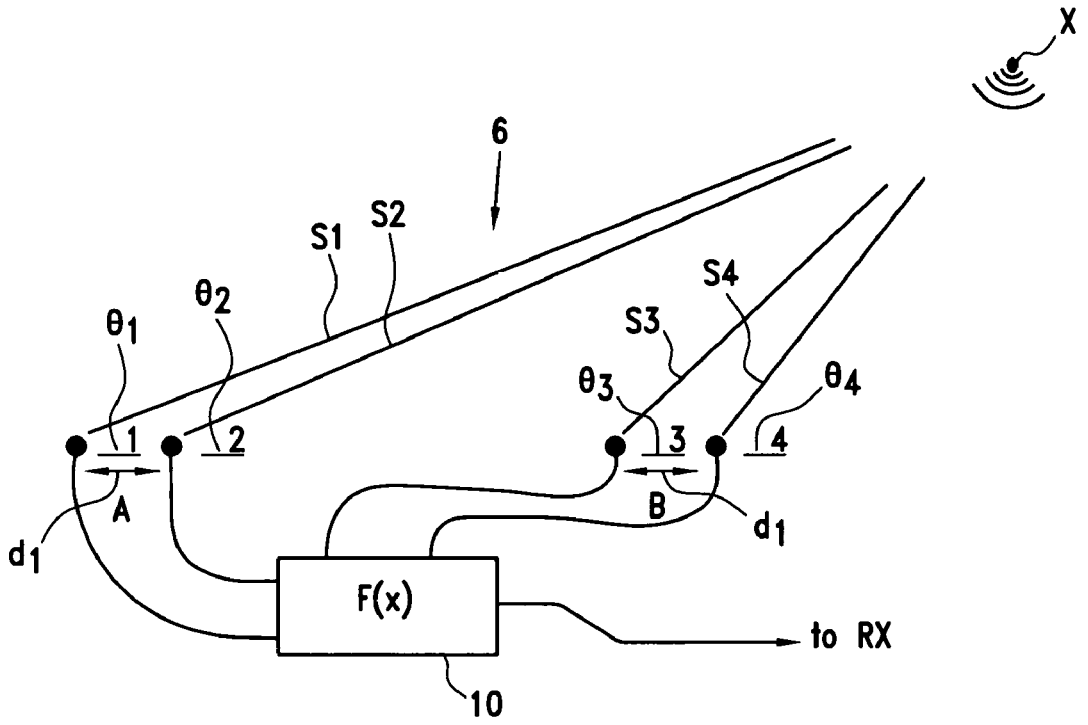
FIG. 1 is schematic block diagram of a four-element, two set antenna array made in accordance with the present invention.

By way of example, a minimal instantiation 4-element 2-set antenna 6 made in accordance with the present invention is disclosed in FIG. 1. The antenna 6 comprises antenna elements 1, 2, 3 and 4. A signal source x generates vectors S1, S2, S3 and S4 representing the signal paths to the respective antenna elements. Each vector forms an angle $\theta_1$, $\theta_2$, $\theta_3$ and $\theta_4$ with the reference plane of the antenna 6. The reference plane is that in which all of the elements lie.

The antenna 6 includes a processing network 10, preferably an analog network to advantageously impose no conditions on the receiver using the antenna. The output of the network 10 is fed to a receiver (not shown). Alternatively, a digital processing network can be used. A digital network would add flexibility but place additional requirements on matching the receiver to the antenna 6 and network 10. An analog network allows the operation of the receiver using the antenna to be not affected by processing delays or tuning in the antenna.

The antenna elements are arranged in sets A, B, . . . N. In the case of the example, set A consists of elements 1 and 2 and set B, elements 3 and 4. Obviously an 8-element 4-set antenna 6 would have four pairs (A, B, C, and D), such as in FIG. 3. The elements in each set are preferably dipoles, separated by distance $d_1$. The elements of each set are preferably fairly close, where $d_1<\lambda/8$ for good gain characteristics and to limit the signal time of arrival difference relative to the wavelength $\lambda$. The sets are widely separated from each other by distance $d_2$, where $d_2>>d_1$.

Although the preferred embodiment for the antenna elements is a dipole configuration, persons skilled in the art will recognize that any omni-directional antenna or even any antenna element with a wide pattern in at least one dimension may be used. Typical omni-directional or wide-pattern antenna elements include monopole, dipole, biconical, discone, helical, spiral, collinear, planar, patch, microstrip, slotted waveguides, any equivalent omni-directional or wide pattern antenna, and any combination thereof.

Figure 4:
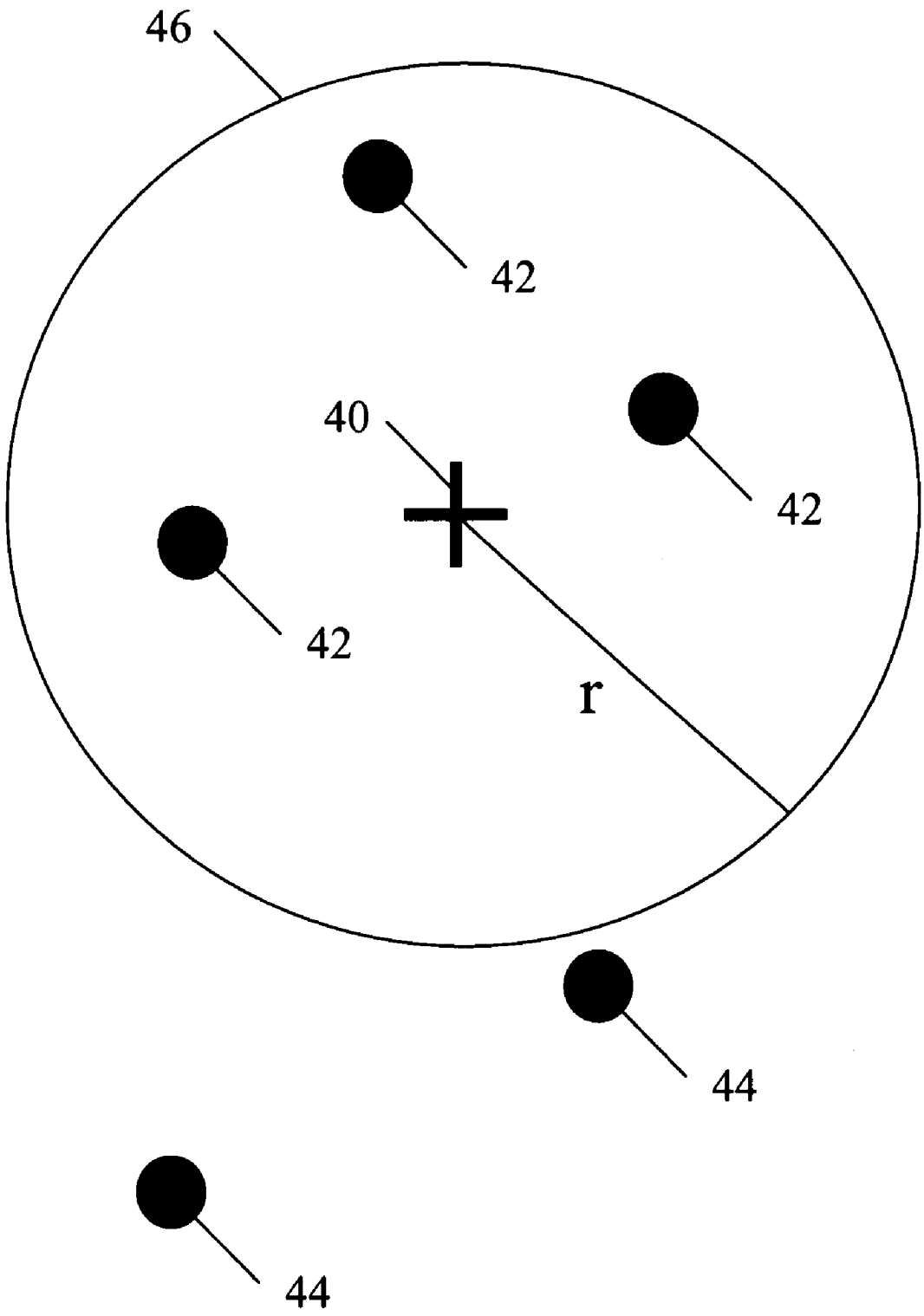
FIG. 4 is a top view of an antenna configured to have source gain with a radius r, and attenuation outside the radius r

By examining the signal phase difference at the elements of the set A, which is related to the angle of arrival, and measuring the same signal phase difference in set B, a determination can be made of the approximate range of the signal source x from the antenna array 6. The further the source x from the antenna array 6, the more equal the phase difference measurements are at sets A and B. The network 10 will pass only the signals for which the difference of the phase angles between the sets, $$F(\Xi,x)=\Phi_A(x)-\Phi_B(x) \ldots +\Phi_{N-1}(x)-\Phi_N(x),$$

is greater than some threshold, $\epsilon$, where F is the function performed by the processing network 10, x is the signal, $\Phi_A(x)$ is the phase angle of signal x at set A, $\Phi_B(x)$ is the phase angle of the signal x at set B, $\Phi_{N-1}(x)$ is the phase angle of signal x at set N−1, $\Phi_N(x)$ is the phase angle of the signal x at set N, and Ξ contains all the additional parameters which bear on the system. The threshold ϵ, is a parameter adjusted by a user to vary the radius from the antenna for which the antenna will have gain for emitted signals from sources therein. Referring to FIG. 4, an antenna 40 is surrounded by a number of signal sources 42 with gain, and a number of signal sources with attenuation 44. The antenna 40 will have gain for signal sources within a radius 46 (i.e. gain signal sources 42) and those outside the radius 46 are attenuated (i.e. attenuated sources 44). If F(Ξ,x)>ϵ, then the signal x is passed by the network Ξ preferably contains terms for noise, interfering signals, and correction factors for non-uniformities in the array (self and mutual impedance, drive point impedance, induction, propagation delays, physical orientation and alignment, quality factor (Q), and the ground plane). Ideally, these are all negligible and therefore not included in the calculation for simplicity. It is well known in the art how to include these terms.

A person of ordinary skill in the art will understand that there are many limiting factors that come into play that may have to be considered, such as the precision of phase angle measurement, multipath, physical dimensions of the array, number of elements, type of elements, etc.

Using the 2 set 4 element example above, the analog network could take the following form:

$$F=(S_1(x)+S_2(x))^{-1}+(S_3(x)+S_4(x)).$$

Persons skilled in the art will recognize that for a system containing Z sets of n elements, $$F=(S_{A,1}(x)+S_{A,2}(x)+\ldots+S_{A,n}(x))^{-1}+(S_{B,1}(x)+\ldots+S_{B,n}(x))+(S_{C,1}(x)+\ldots+S_{C,n}(x))^{-1}+(S_{D,1}(x)+\ldots+S_{D,n}(x))+\ldots+(S_{Z-1,1}(x)+\ldots+S_{Z-1,n}(x))^{-1}+(S_{Z,1}(x)+\ldots+S_{Z,n}(x)),$$

$S_k(x)$, the signal at location k due to the source x, can be expressed as $S_k(\omega,t)$ where ω is a vector of the frequencies in the signal S and t is the time. Since ω is the same for a particular signal for all antenna elements in an ideal case, the term may be dropped later. Then, $$S_1(x)+S_2(x)=S(\omega,t)+S(\omega,t+\tau_{12})$$

where $\tau_{12}$ is the phase difference of S between antenna elements 1 and 2. Geometrically, the phase difference may be defined as, $$\tau_{12}=(d_1\cos\theta_1)/c,$$

where $d_1$ is the distance between antenna elements 1 and 2, $\theta_1$ is the angle of arrival of $S_1$ at element 1 and c is the speed of light. This formula can be used if over the distance $d_1$ the wavefront from source x is flat. The same cannot be assumed over the distance $d_2$ Putting $S_1$ and $S_3$ into a cross correlator will yield $\tau_{13}$, the phase delay between $S_1$ and $S_3$ or the phase delay between element sets A and B. Using $\tau_{13}$ to set a delay line (with delay $D=\tau_{13}$) on the output of the B set of antenna elements will make it in-phase with the output from the A set.

Thus, for F(x), $$F=(S_1(t)+S_2(t+\tau_{12}))^{-1}+D(S_3(t)+S_4(t+\tau_{34})).$$

The phase delays $\tau_{12}$ and $\tau_{34}$ will differ from each other as a function of the distance of source x from the antenna. Inverting the sum of the signal waveform from the set A elements and adding it to the delayed signal waveform sum from the set B elements is a simple analog function.

Expressed in terms of phase angles, $$\Phi_A(x)=\theta_1(x)-\theta_2(x) \text{ and } \Phi_B(x)=\theta_3(x)-\theta_4(x).$$

For a set of 3 elements, $$\Phi_A(x)=\theta_1(x)-2\theta_2(x)+\theta_3(x),$$

for a set of 4 elements, $$\Phi_A(x)=\theta_1(x)-2\theta_2(x)+2\theta_3(x)-\theta_4(x),$$

for a set of 5 elements, $$\Phi_A(x)=\theta_1(x)-2\theta_2(x)+2\theta_3(x)-2\theta_4(x)+\theta_5(x),$$

and in the same pattern for sets with larger numbers of elements.

Figure 2:
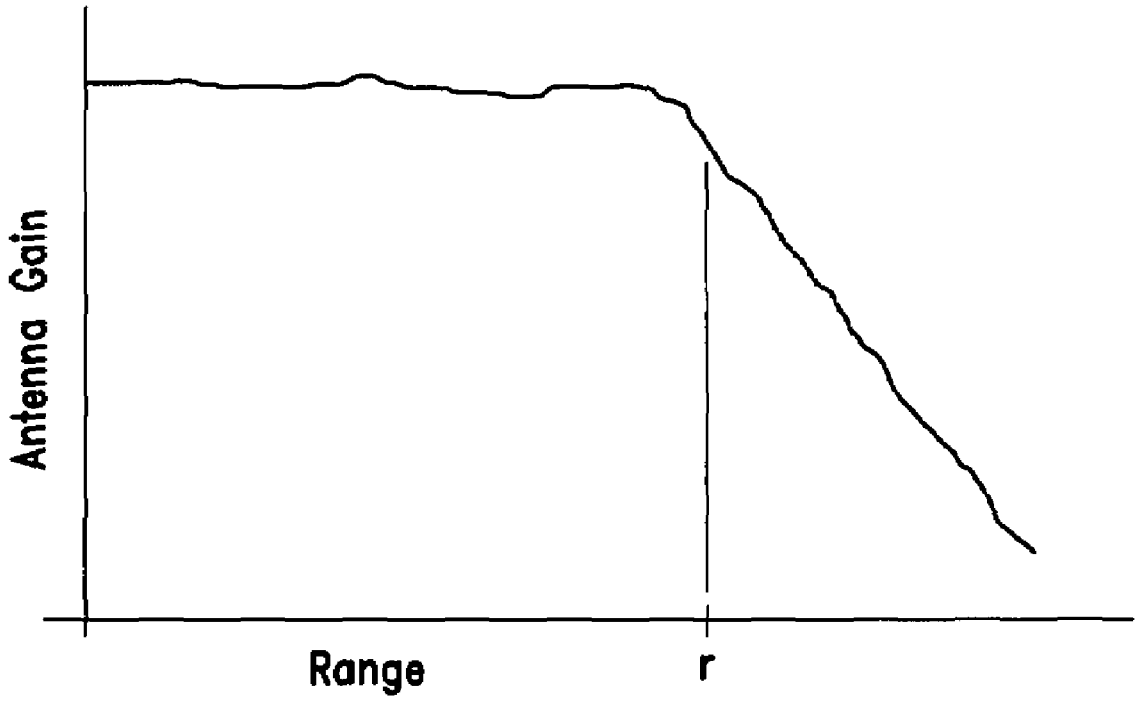
FIG. 2 is a graph of the antenna gain of FIG. 1, showing a cutoff radius r.

The further the signal x is from the antenna array 6, the more equal $\Phi_A(x)$ and $\Phi_B(x)$ become so that their difference tends to zero and the value of F(x) decreases. For the simple analog network 10, the antenna gain as a function of radius r would be continually decreasing with increasing r, as shown in FIG. 2. The value of $d_2$ would affect the slope of the curve. A person of ordinary skill in the art will understand that the range may be selected by changing the design parameters of the antenna and/or the function of the signal-processing network. A typical radius r may be 50 meters. The roll-off of the antenna system as source range increases beyond design cut-off radius, $r_c$, (−3 dB point) is preferably in the order of −10 $((r-r_c)/r_c)$dB or better. Response flatness over the frequency range is preferably better than 10 dB. A signal with −80 dbm at the antenna location should preferably be passed by the system to the receiver with at least 10 dB signal-to-noise ratio. The antenna system frequency range is preferably 1 MHz to 3 GHz, but is most likely optimized for a smaller frequency range dependant on the application.

An digital network would require some form of tuning frequency feedback from the receiver if the tuning range is wide. However, an digital network would advantageously provide significantly more mathematical functions that could be used in the derivation of the function F for most situations. For example, $\theta_1$, $\theta_2$, $\theta_3$, $\theta_4$ could be directly measured in a digitized set of waveforms.

Figure 3:
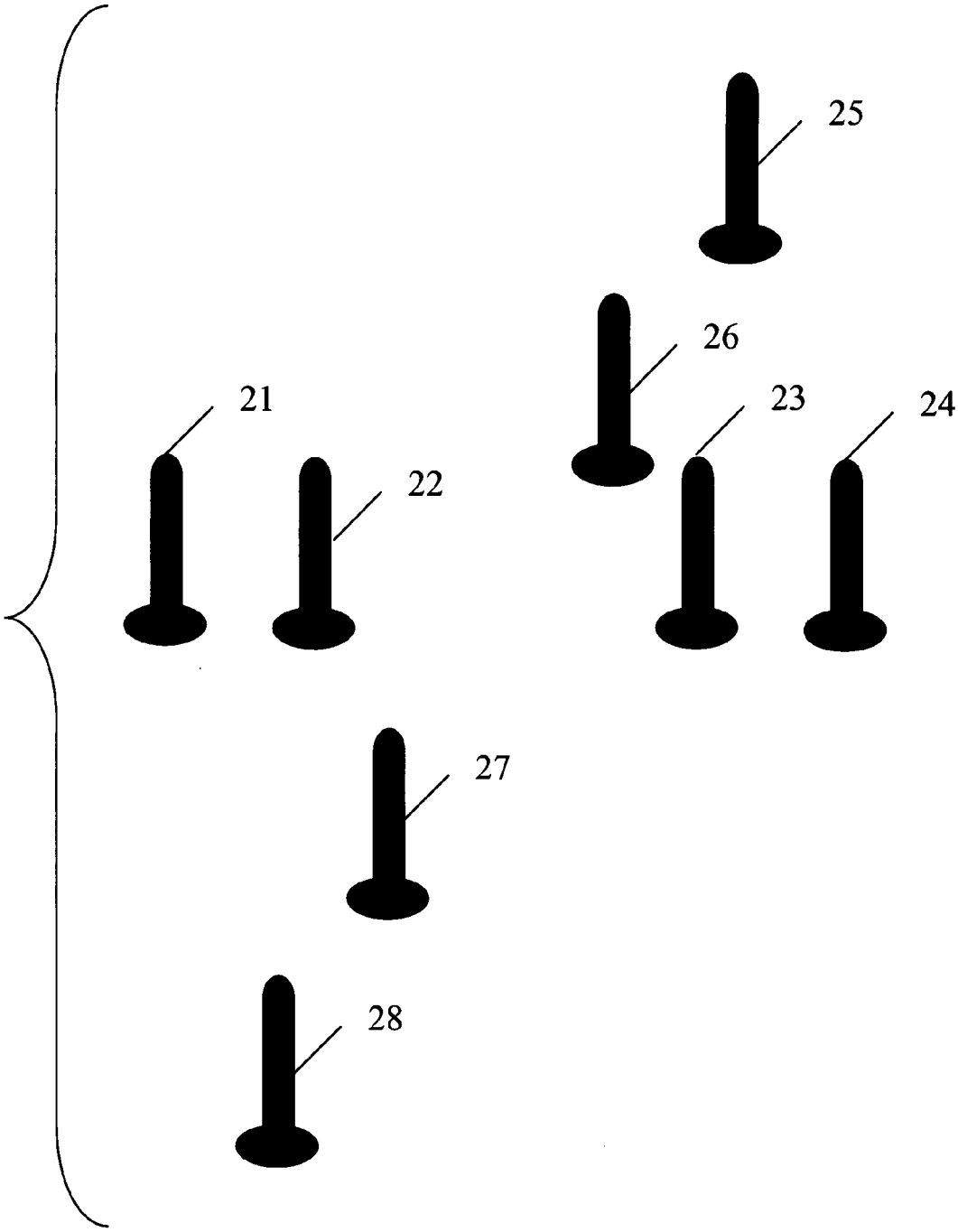
FIG. 3 is a perspective view of a four set antenna array layout made in accordance with the present invention.

FIG. 3 shows a two dimensional array of eight elements 21-28. A signal source in any direction from the antenna could be accommodated. More complex permutations of array elements of this type could be used to increase range sensitivity and/or improve the frequency bandwidth of the antenna. By using various sets of elements in the array, given accurate. calibration of the physical dimensions of the array and the electrical characteristics of each element at its feed point, a more accurate and robust range filtering can be performed.

A person of ordinary skill in the art will recognize that the present invention may be viewed as the complement of a common antenna design goal of designing an antenna that is insensitive to sources close to it. By inverting the network function F, one may also invert the antenna's characteristic sensitivity vs. signal source range. Thus, the antenna could be placed close to strong emitters without conducting an overload level of energy to the front end of a receiver connected to it. That is, the curve of FIG. 2 would be reversed left to right, showing attenuation within the radius and gain outside the radius. Given a known emitter layout, an inverse range limited antenna network function $F^{-1}$ could be designed to null those emitters.

While this invention has been described as having a preferred design, it is understood that it is capable of further modification, uses and/or adaptations following in general the principles of the invention and including such departures from the present disclosure as come within known or customary practice in the art to which the invention pertains, and as may be applied to the essential features set forth, and fall within the scope of the invention or the limits of the appended claims

I claim:

1. A range limited antenna, comprising:

a) at least two sets of antenna elements;

b) RF signal processing network connected to the at least two sets of antenna elements;

c) the RF signal processing network having a function, $$F(\Xi,x)=\Phi_A(x)-\Phi_B(x)+\Phi_C(x)-\Phi_D(x)\ldots+\Phi_{N-1}(x)-\Phi_N(x),\text{ where x is a signal,}$$

$\Phi_A(x)$ is the phase angle of signal x at the first antenna element set, $\Phi_B(x)$ is the phase angle of signal x at the second antenna element set, $\Phi_C(x)$ is the phase angle of signal x at the third antenna element set, $\Phi_D(x)$ is the phase angle of signal x at the fourth antenna element set, $\Phi_{N-1}(x)$ is the phase angle of signal x at the N−1st antenna element set, $\Phi_N(x)$ is the phase angle of signal x at the $N^{th}$ antenna element set, and $\Xi$ contains all additional parameters which bear on the system; and d) the RF signal processing network is configured to pass a signal for which $$F(\Xi,x)>\epsilon,$$

where $\epsilon$ is a threshold amount, adjustable to vary a radius from the antenna for which the antenna will have gain for emitted signals within the radius and has attenuation outside the radius.

2. A range limited antenna as in claim 1, wherein said antenna is selected from the group of antenna consisting of omni-directional, wide pattern, monopole, dipole, biconical, discone, helical, spiral, collinear, planar, microstrip, slotted waveguides, any equivalent antenna, and any combination thereof.

3. A range limited antenna as in claim 2, wherein:

a) each at least two sets of antenna elements are omni-directional antenna elements having a separation distance dl between omni-directional antenna elements; and b) each omni-directional antenna set is separated from each remaining omni-directional antenna set by a distance d2, where d1<λ/8 and d2>>d1.

4. A range limited antenna as in claim 3, wherein said network is, $$F=(S_{A,1}(x)+S_{A,2}(x)+\ldots+S_{A,n}(x))^{-1}+(S_{B,1}(x))+(S_{C,1}(x)+\ldots+S_{C,n}(x))^{-1}+(S_{D,1}(x)+\ldots+S_{D,n}(x))+\ldots+(S_{Z-1,1}(x)+\ldots+S_{Z-1,n}(x))^{-1}+(S_{Z,1}(x)+\ldots+S_{Z,n}(x)),$$

where, $S_{A,1}(x)$ and $S_{A,n}(x)$ are the signals on the first set of omni-directional antenna elements due to source x, $S_{B,1}(x)$ and $S_{B,n}(x)$ are the signals on the second set of omni-directional antenna elements due to source x, and $S_{Z,1}(x)$ and $S_{Z,n}(x)$ are the signals on the $Z^{th}$ set of omni-directional antenna elements due to source x.

5. A range limited antenna as in claim 4, wherein said network is analog.

6. The range limited antenna as in claim 5, wherein said network is digital.

7. A range limited antenna as in claim 1, wherein:

a) each at least two sets of antenna elements are omni-directional antenna elements having a separation distance d1 between omni-directional antenna elements; and b) each omni-directional antenna set is separated from each remaining omni-directional antenna set by a distance d2, where d1<λ/8 and d2>>d1.

8. A range limited antenna as in claim 1, wherein said network is, $$F=(S_{A,1}(x)+S_{A,2}(x)+\ldots+S_{A,n}(x))^{-1}+(S_{B,1}(x)+\ldots+S_{B,n}(x))+(S_{C,1}(x)+\ldots+S_{C,n}(x))^{-1}+(S_{D,1}(x)+\ldots+S_{D,n}(x))+\ldots+(S_{Z-1,1}(x)+\ldots+S_{Z-1,n}(x))^{-1}+(S_{Z,1}(x)+\ldots+S_{Z,n}(x)),$$

where, $S_{A,1}(x)$ and $S_{A,n}(x)$ are the signals on the first set of omni-directional antenna elements due to source x, $S_{B,1}(x)$ and $S_{Bn}(x)$ are the signals on the second set of omni-directional antenna elements due to source x, and $S_{Z,1}(x)$ and $S_{Z,n}(x)$ are the signals on the $Z^{th}$ set of omni-directional antenna elements due to source x.

9. A range limited antenna as in claim 1, wherein said network is analog.

10. The range limited antenna as in claim 1, wherein said network is digital.

11. A range limited antenna, comprising:

a) at least two sets of antenna elements;

b) RF signal processing network connected to the at least two sets of antenna elements;

c) the RF signal processing network having a function, $$F(\Xi,x)=\Phi_A(x)-\Phi_B(x)+\Phi_C(x)-\Phi_D(x)\ldots+\Phi_{N-1}(x)-\Phi_N(x),\text{ where x is a signal,}$$

$\Phi_A(x)$ is the phase angle of signal x at the first antenna element set, $\Phi_B(x)$ is the phase angle of signal x at the second antenna element set, $\Phi_C(x)$ is the phase angle of signal x at the third antenna element set, $\Phi_D(x)$ is the phase angle of signal x at the fourth antenna element set, $\Phi_{N-1}(x)$ is the phase angle of signal x at the N−1st antenna element set, $\Phi_N(x)$ is the phase angle of signal x at the $N^{th}$ antenna element set, and $\Xi$ contains all additional parameters which bear on the system; and d) the RF signal processing network is configured to pass a signal for which $$F(\Xi,x)<\epsilon,$$

where $\epsilon$ is a threshold amount, adjustable to vary a radius from the antenna for which the antenna will have gain for emitted signals within the radius and has attenuation outside the radius.

12. A range limited antenna as in claim 11, wherein said antenna is selected from the group of antenna consisting of omni-directional, wide pattern, monopole, dipole, biconical, discone, helical, spiral, collinear, planar, microstrip, slotted waveguides, any equivalent antenna, and any combination thereof.

13. A range limited antenna as in claim 12, wherein:

a) each at least two sets of antenna elements are omni-directional antenna elements having a separation distance d1 between omni-directional antenna elements; and b) each omni-directional antenna set is separated from each remaining omni-directional antenna set by a distance d2, where d1<λ/8 and d2>>d1.

14. A range limited antenna as in claim 13, wherein said network is, $$F=(S_{A,1}(x)+S_{A,2}(x)+\ldots+S_{A,n}(x))^{-1}+(S_{B,1}(x)+\ldots+S_{B,n}(x))+(S_{C,1}(x)+\ldots+S_{C,n}(x))^{-1}+(S_{D,1}(x)+\ldots+S_{D,n}(x))+\ldots+(S_{Z-1,1}(x)+\ldots+S_{Z-1,n}(x))^{-1}+(S_{Z,1}(x)+\ldots+S_{Z,n}(x)),$$

where, $S_{A,1}(x)$ and $S_{A,n}(x)$ are the signals on the first set of omni-directional antenna elements due to source x, $S_{B,1}(x)$ and $S_{B,n}(x)$ are the signals on the second set of omni-directional antenna elements due to source x, and $S_{Z,1}(x)$ and $S_{Z,n}(x)$ are the signals on the $Z^{th}$ set of omni-directional antenna elements due to source x.

15. A range limited antenna as in claim 14, wherein said network is analog.

16. The range limited antenna as in claim 15, wherein said network is digital.

17. A range limited antenna as in claim 11, wherein:

a) each at least two sets of antenna elements are omni-directional antenna elements having a separation distance d1 between omni-directional antenna elements; and b) each omni-directional antenna set is separated from each remaining omni-directional antenna set by a distance d2, where d1<λ/8 and d2>>d1.

18. A range limited antenna s in claim 11, wherein said network is, $$F=(S_{A,1}(x)+S_{A,2}(x)+\ldots+S_{A,n}(x))^{-1}+(S_{B,n}(x))+(S_{C,1}(x)+\ldots+S_{C,n}(x))^{-1}+(S_{D,1}(x)+\ldots+S_{D,n}(x))+\ldots+(S_{Z-1,1}(x)+\ldots+S_{Z-1,n}(x))^{-1}+(S_{Z,1}(x)+\ldots+S_{Z,n}(x)),$$

where, $S_{A,1}(x)$ and $S_{A,n}(x)$ are the signals on the first set of omni-directional antenna elements due to source x, $S_{B,1}(x)$ and $S_{B,n}(x)$ are the signals on the second set of omni-directional antenna elements due to source x, and $S_{Z,1}(x)$ and $S_{Z,n}(x)$ are the signals on the $Z^{th}$ set of omni-directional antenna elements due to source x.

19. A range limited antenna as in claim 11, wherein said network is analog.

20. The range limited antenna as in claim 11, wherein said network is digital.

* * * * *